US005813739A

United States Patent [19]

White

[11] Patent Number: 5,813,739

[45] Date of Patent: Sep. 29, 1998

[54] FLAMMABLE MATERIAL STORAGE CABINET

[75] Inventor: Joseph J. White, Collegedale, Tenn.

[73] Assignee: Collegedale Casework, LLC, Collegedale, Tenn.

[21] Appl. No.: 960,006

[22] Filed: Oct. 29, 1997

[51] Int. Cl.[6] ..... A47B 88/00

[52] U.S. Cl. ..... 312/409; 49/7; 220/201

[58] Field of Search ..... 312/409, 326, 312/319.2, 293.2; 220/201; 49/1, 7, 8

[56] References Cited

U.S. PATENT DOCUMENTS

| | | | |
|---|---|---|---|
| 4,146,994 | 4/1979 | Williams | 49/367 |
| 4,262,448 | 4/1981 | Flider | 49/367 |
| 4,337,988 | 7/1982 | Schneck | 312/280 |
| 4,615,454 | 10/1986 | Verhoog, Jr. | 220/201 |
| 4,619,076 | 10/1986 | Livingston | 49/367 |
| 5,061,022 | 10/1991 | Meriwether | 321/324 |
| 5,582,472 | 12/1996 | Lyons et al. | 312/324 |

OTHER PUBLICATIONS

NFPA 30, pp. 30–31, 1996 Ed.

Hamilton Max Lab Furniture System Bases Specification Sheets, no date.

Campbell Rhea Flammable Storage Bases Specification Sheet, Jan. 1994.

Kewaunee Flammable Storage Base Specification Sheets, Sep. 1995.

Flinn Flammable Storage Base Specification Sheets, no date.

Eagle Flammable Storage Base Specification Sheet, no date.

Se–Cur–All Flammable Storage Base Specification Sheets, no date.

CCI Drying, Acid and Solvent Storage Bases Specification Sheets, no date.

*Primary Examiner*—Peter M. Cuomo
*Assistant Examiner*—Gerald A. Anderson
*Attorney, Agent, or Firm*—Miller & Martin LLP

[57] ABSTRACT

An improved, under-counter flammable material storage cabinet which complies with all present fire codes and which overcomes problems associated with access to the utility conduits behind the storage cabinet is provided. The cabinet is self-closing in the presence of internal or external heat to either contain a fire within the cabinet or to keep materials inside the cabinet from combusting from an external fire. The cabinet advantageously utilizes a wooden storage container insert which may be removably affixed within the cabinet frame to provide a storage area wherein flammable materials can be safely stored while at the same time allowing access as necessary to utility conduits installed behind the cabinets.

20 Claims, 2 Drawing Sheets

FLAMMABLE MATERIAL STORAGE CABINET

BACKGROUND OF THE INVENTION

The present invention relates generally to cabinets. More specifically, the present invention relates to a laboratory cabinet which provides needed access to utility conduits while at the same time providing safe storage of flammable materials.

In many environments such as laboratory and industrial work spaces, solvents, paints and other flammable materials must be carefully stored. The storage of these materials is of such importance that it must meet certain requirements and specifications, such as those established by the National Fire Protection Association, the Uniform Fire Code (adopted by many states), and OSHA. Among other things, such regulations mandate specifications for heat resistance, wall construction, self-closing and self-latching doors, leakage control, venting rates and means, and external warning signs. Many cabinets, both fixed and mobile, are known which provide various safeguards to accomplish safe storage of flammable materials.

In these environments, it is also desirable to have fixed counter tops with various utility outlets readily accessible thereon, e.g., electricity, gas, water, etc. For practical as well as ascetic purposes, the utility conduits supplying these outlets are typically installed underneath the counter against the wall. However, with the installation of flammable materials storage cabinets underneath the counter, ready access to such conduits is blocked by the rear wall of the cabinet. If it becomes necessary to cut through the rear wall of the cabinet to access the utility conduits, the integrity of the storage space is compromised, rendering it useless thereafter for the safe storage of flammable materials.

SUMMARY OF THE INVENTION

The present invention provides an improved, under-counter flammable material storage cabinet which complies with all present fire codes and which overcomes problems associated with access to the utility conduits behind the storage cabinet. The cabinet is self-closing in the presence of internal or external heat to either contain a fire within the cabinet or to keep materials inside the cabinet from combusting from an external fire. The cabinet advantageously utilizes a wooden cabinet insert which may be removably affixed within the cabinet frame to provide a storage area wherein flammable materials can be safely stored. The insert simplifies construction and installation of the cabinets and counters, and can also be used in conjunction with custom-built cabinets, thereby greatly reducing the costs typically associated with flammable material storage cabinets. Because the preferred embodiment is wooden, the cabinets of the present invention can more easily be built to the specifications or space limitations of the room into which they are to be installed than metal flammable material storage cabinets. Similarly, because made of wood, the cabinet inserts of the present invention can easily and inexpensively be used to retro-fit existing fixed, under-counter cabinets with flammable material storage capabilities.

It is, therefore, a principal object of the present invention to provide a flammable material storage cabinet which complies with all present fire codes and which overcomes problems associated with access to the utility conduits behind the storage cabinet.

It is a further object of the present invention to provide a flammable material storage cabinet which allows reasonable access to utility conduits behind the cabinet.

It is also an object of the present invention to provide a flammable material storage cabinet which may be inexpensively installed in standard, custom-built, or existing cabinet frames.

These and other objects, advantages and applications of the present invention will become apparent to those skilled in the art when the accompanying description of the preferred embodiment of the present invention is read in conjunction with the accompanying drawings.

DETAILED DESCRIPTION OF THE DRAWINGS

Figure 1:
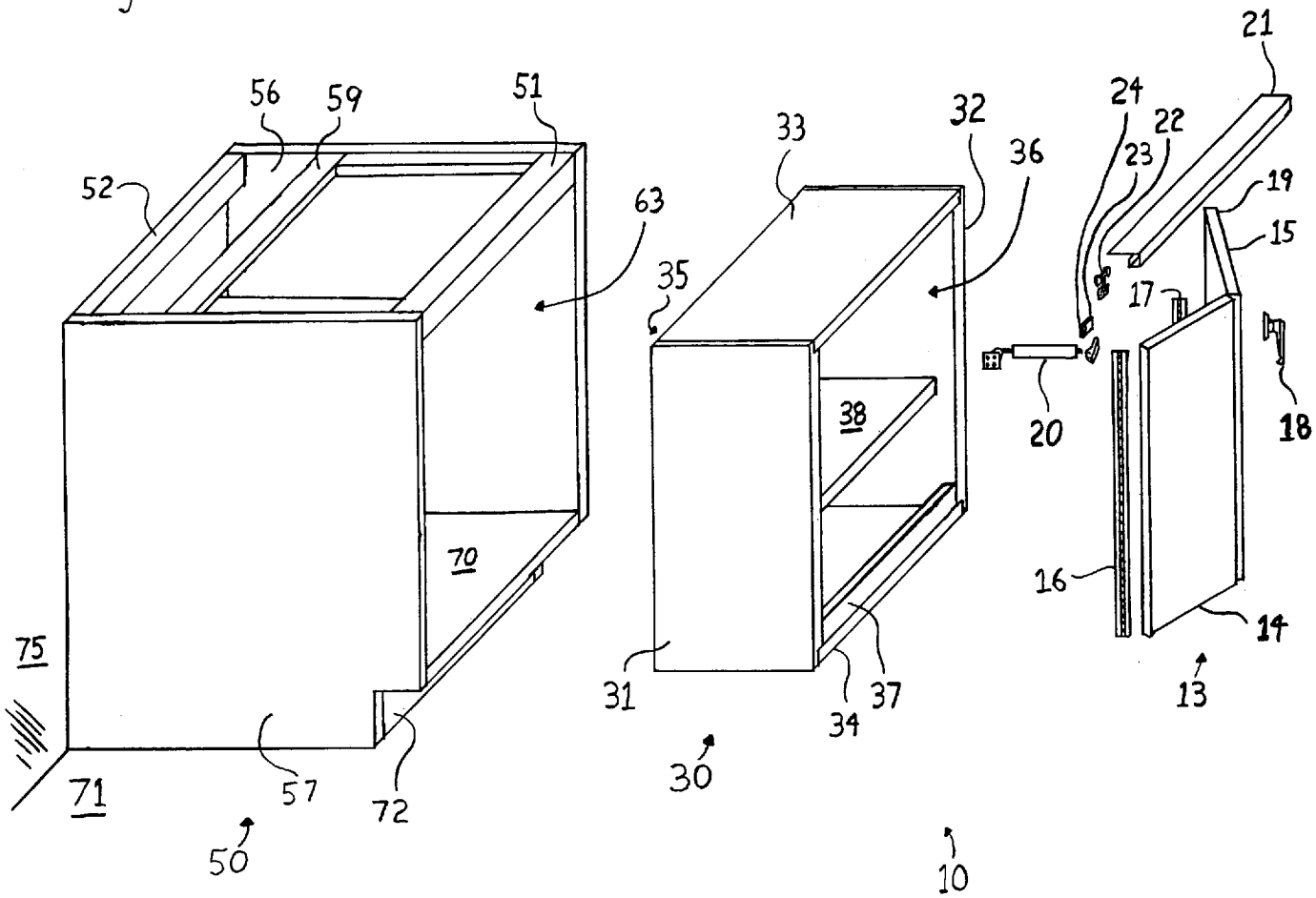
FIG. 1 is an exploded perspective view of the flammable material storage cabinet of the present invention.

Referring now to the drawings and in particular to FIG. 1, an exploded perspective view of the flammable material storage cabinet 10 of the present invention is shown. The cabinet 10 includes cabinet frame, such as support 50, storage container insert 30, and a self-closing door, such as bi-fold doors 13.

Figure 2:
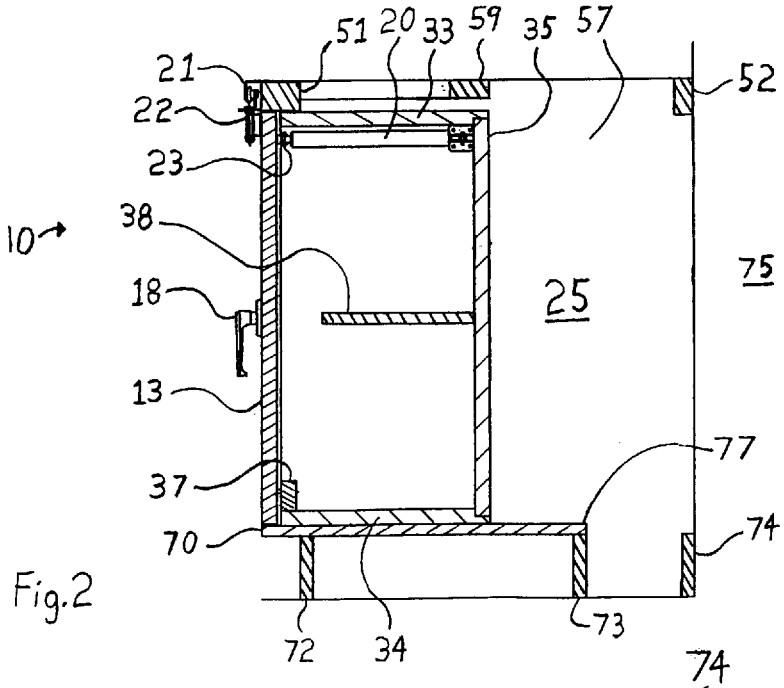
FIG. 2 a side cross-sectional view of the flammable material storage cabinet of the present invention with door in the closed position.

Support 50 may be a standard cabinet frame, a frame custom-built to desired specifications, or an existing frame, and is preferably constructed of at least 1 inch thick plywood, though the support 50 may permissibly be constructed of metal. In one preferred embodiment, support 50 comprises a rectangular support for a generally horizontal work surface or counter top (not shown). Support 50 has a front (not numbered), a rear (not numbered) and a base 70 and is formed, for example, in rigid frame construction and includes front longitudinal beam 51, rear longitudinal beam 52 adjacent to, and preferably affixed to, wall 75, and base 70 which rests upon floor 71 or, as shown in FIG. 2, is attached to base supports 72 and 73 which rest upon floor 71. One or more frame panels 56, 57 join longitudinal beams 51 and 52 and base 70. In one preferred embodiment shown in FIG. 2, base 70 is attached at a rear edge 77 to base support 73. Base support 74 joins frame panels 56 and 57. Base support 74 is adjacent and preferably affixed to wall 75. Rear longitudinal beam 52 may be supported by attachment of beam 52 to wall 75.

In the preferred embodiment shown in FIG. 2, frame panels 56 (not shown) and 57 also join base supports 72, 73, and 74. Finally, in one preferred embodiment, one or more mid-longitudinal beams 59 join the frame panels 56, 57 substantially parallel to front and rear longitudinal beams 51, 52 co-planar with rear panel 35 of insert 30 when insert is installed in support 50.

All components of support 50 are preferably joined by any number of fastening means known in the art, such as common adhesives which meet applicable fire codes or metal fasteners.

Returning then to FIG. 1, the storage container insert 30 generally has a closed rear portion, such as rear panel 35, and an open front portion 36 and, in one preferred embodiment, comprises a rectangular enclosure or housing with side panels 31 and 32, a top panel 33, a bottom panel 34, a rear panel 35, and an open front portion 36 defined by side panels 31, 32, top panel 33, and bottom panel 34 in a frame-like manner. All panels are preferably joined by rabbetted joints to add strength and stability. Joints are fastened by any number of fastening means known in the art, such as common adhesives which meet applicable fire codes or metal fasteners.

The enclosure has a raised sill or pan capable of containing at least a 2 inches depth of liquid, such as lip 37 between side panels 31, 32 across bottom panel 34 to retain liquid spilled within the enclosure. Finally, insert 30 may contain one or more adjustable shelves 38.

One or more vents with spark screens (not shown) may be provided in the enclosure to vent the enclosure to the atmosphere. Vents are preferably constructed of a fireproof material such as metal.

All components of the insert 30 except for vents are preferably constructed of wood at least 1 inch thick, preferably exterior grade plywood or wood of a type that will not break down or delaminate under fire conditions in order to meet applicable burn-through fire resistance standards.

The insert 30 is sized to be removably installed within support 50 by a plurality of bolts (not shown) of the type satisfying fire code requirements. For example, bolts may be driven through bottom panel 34 into base 70.

While it is necessary that the outer dimensions of the insert 30 be smaller than the inner dimensions of the front opening 63 defined by front longitudinal beam 51, frame panels 56, 57, and base 70 of support 50 so that insert 30 may be installed within support 50, it is preferable that the outer dimensions of the insert 30 approximate the inner dimensions of said front opening 63 so that the available storage area is maximized without inhibiting removal of the insert 30.

As shown in FIG. 2, front opening 36 (not numbered) of insert 30 is preferably recessed within the front opening 63 (not numbered) of support 50 a distance approximately equal to the thickness of bi-fold doors 13 so that, as explained more fully below, doors 13 rest flush against the front opening 36 (not numbered) of the inert 30 when doors 13 are in the closed position.

In order to provide an opening through which utility conduits may pass, it is preferable that the insert 30 be sized relative to the support 50 such that when the insert 30 is removably installed with the open front portion 36 proximate to the front 63 of the support 50, a space 25 (shown in FIGS. 2 and 3) remains within the support 50 behind the rear portion of the insert. Since insert 30 is constructed of wood, it may be conveniently sized to fit the desired specifications of new or existing cabinet frames and to provide a sufficient space 25 to accommodate the desired utility conduits (not shown).

Figure 3:
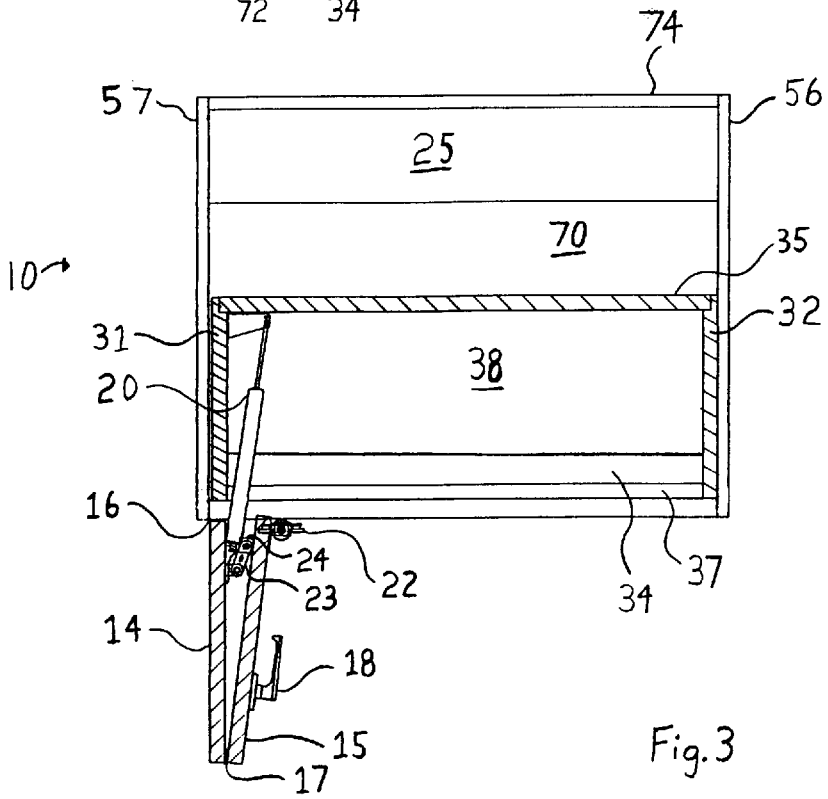
FIG. 3 is a top cross-sectional view of the flammable material storage cabinet of the present invention with door in the open position.

Returning then to FIG. 1, in the preferred embodiment of the present invention, a self-closing door biased to a closed position, such as bi-fold doors 13, is flexibly attached to frame panel 57 by continuous hinge 16. As best shown in FIG. 2, the door 13 is sized to fit flush within the front opening 63 of support 50 and to seal off the open front portion 36 of the insert 30 when in a closed position. Like the insert, self-closing doors 13 are preferably constructed of at least 1 inch thick wood to meet applicable fire codes. In the preferred embodiment of the present invention shown in FIG. 1, self-closing door comprises the illustrated bi-fold doors 13, including left and right panels 14, 15 flexibly attached together by middle continuous hinge 17. A slidable retaining device is provided for retaining right panel 15 proximate front opening 63. In the preferred embodiment, the slidable retaining device comprises steel track 21 affixed to longitudinal beam 51 and shuttle 22, said shuttle 22 being housed within track 21 and flexibly attached to the distal end 19 of right panel 15 such that as bi-fold doors 13 are opened (as shown in FIG. 3), shuttle 22 slides within track 21 (not shown in FIG. 3), retaining distal end 19 of right panel 15 of bi-fold door 13 proximate front opening 63 of support 50.

A handle for opening the door (not shown) also preferably includes a lock, such as the illustrated two-point, lockable latch handle 18.

In the preferred embodiment, self-closing door is biased to a closed position, such as by hydraulic door closer 20. A door catch device is provided to retain door in an open position, such as illustrated in FIG. 3, and to release the door under heat or fire conditions, such as when the ambient temperature reaches a preselected temperature. In one preferred embodiment, said door catch device comprises a magnetic catch 23 with fusible link 24 which, at a preselected ambient temperature, fuses or melts, thus releasing the door and enabling hydraulic door closer 20 to pull the door into a closed position. If desired, the self-closing door may be spring-loaded to ensure that the doors 13 will close when fusible link 24 melts.

Turning then to FIG. 2, a side cross-sectional view of the flammable material storage cabinet 10 of the present invention is shown with self-closing doors 13 in the closed position. As shown, the flammable material storage cabinet is formed by removably installing storage container insert 30 upon base 70 within support 50 such that it is recessed within the front opening 63 (shown in FIG. 1) of support 50 a distance approximately equal to the thickness of doors 13. Doors 13 are then attached to support 50 so that they seal off the front opening 36 (shown in FIG. 1) of the insert 30, thereby completing the enclosure for the safe storage of flammable material. Doors are retained in the closed position by hydraulic door closer 20. Steel track 21 housing shuttle 22 is affixed to longitudinal beam 51, shuttle 22 also being flexibly attached to doors 13. Thus, it can be seen that a flammable material storage cabinet is formed, yet a space 25 remains between rear panel 35 of insert 30 for the housing of utility conduits (not shown). Reasonable access may be had to any such utility conduits without permanently compromising the integrity of the flammable material storage cabinet by simply removing storage container insert 30.

Turning then to FIG. 3, a top cross-sectional view of the flammable material storage cabinet 10 of the present invention is shown with doors 13 in the open position. As shown, when in the open position, the preferred bi-fold doors 13 are retained in the open position by magnetic catch 23 with fusible link 24, thus preventing the bi-fold doors 13 from being pulled closed by the extended hydraulic door closer 20. In the event of a fire, at a preselected ambient temperature, the heat-fusible material forming the fusible link 24 fuses or melts thereby releasing magnetic catch 23 and allowing hydraulic door closer 20 to close bi-fold doors 13, thus sealing the enclosure of the insert 30, either keeping any flammable materials within the enclosure away from the fire or retaining the fire within the enclosure.

While several embodiments of the present invention have been disclosed, it is to be understood by those skilled in the art that other forms can be adopted, all coming within the spirit of the invention and scope of the appended claims:

I claim:

1. A flammable material storage cabinet comprising:

(a) a cabinet frame having a front, a rear and a base;

(b) a storage container insert removably installed within the cabinet frame, the storage container insert having a closed rear portion and an open front portion and being constructed of wood;

(c) wherein the storage container insert is sized relative to the cabinet frame such that when the storage container insert is installed with the open front portion proximate to the front of the cabinet frame, a space remains within the cabinet frame behind the rear portion of the storage container insert;

(d) the storage container insert further comprising a pan capable of containing at least a two inch depth of liquid;

(e) a door biased to a closed position to seal the open front portion of the storage container insert; and (f) a door catch device for retaining the door in an open position and releasing the door in the presence of a preselected ambient temperature.

2. The flammable material storage cabinet of claim 1 wherein the wood from which the storage container insert is constructed is at least a one inch thick.

3. The flammable material storage cabinet of claim 1 wherein the wood from which the storage container insert is constructed is exterior grade plywood.

4. The flammable material storage cabinet of claim 1 wherein the wood from which the storage container insert is constructed is wood of a type that will not break down or delaminate under fire conditions.

5. The flammable material storage cabinet of claim 1 wherein the door is constructed of wood at least a one inch thick.

6. The flammable material storage cabinet of claim 1 wherein the storage container insert further comprises a rectangular enclosure formed by at least two side panels, a top panel, a bottom panel and a rear panel joined by fasteners.

7. The flammable material storage cabinet of claim 6 wherein the pan further comprises a raised sill across the bottom panel between the side panels.

8. The flammable material storage cabinet of claim 1 wherein the door further comprises bi-fold doors.

9. The flammable material storage cabinet of claim 8 wherein the bi-fold doors are biased to a closed position by a hydraulic door closer.

10. The flammable material storage cabinet of claim 1 wherein the door catch device further comprises a magnetic catch with a fusible link.

11. A flammable material storage cabinet comprising:

(a) a cabinet frame having a front, a rear and a base;

(b) an insert constructed of wood and having at least two side panels, a top panel, a bottom panel and a rear panel joined by fasteners and defining a rectangular enclosure, the enclosure having an open front portion defined in frame-like manner by the side panels, top panel and bottom panel;

(c) wherein the insert is removably installed within the cabinet frame;

(d) wherein the insert is sized relative to the cabinet frame such that when the insert is installed with the open front portion proximate to the front of the cabinet frame, a space remains within the cabinet frame behind the rear panel;

(e) the insert further comprising a pan capable of containing at least a two inch depth of liquid;

(f) a self-closing door to seal the open front portion of the insert when in a closed position; and (g) a door catch device for retaining the door in an open position and releasing the door in the presence of a preselected ambient temperature.

12. The flammable material storage cabinet of claim 11 wherein the wood from which the insert is constructed is at least a one inch thick.

13. The flammable material storage cabinet of claim 11 wherein the wood from which the insert is constructed is exterior grade plywood.

14. The flammable material storage cabinet of claim 11 wherein the wood from which the insert is constructed is wood of a type that will not break down or delaminate under fire conditions.

15. The flammable material storage cabinet of claim 11 wherein the self-closing door is constructed of wood at least a one inch thick.

16. The flammable material storage cabinet of claim 11 wherein the pan further comprises a raised sill across the bottom panel between the side panels.

17. The flammable material storage cabinet of claim 11 wherein the self-closing door further comprises bi-fold doors.

18. The flammable material storage cabinet of claim 17 wherein the bi-fold doors are biased to a closed position by a hydraulic door closer.

19. The flammable material storage cabinet of claim 11 wherein the door catch device further comprises a magnetic catch with a fusible link.

20. A flammable material storage cabinet comprising:

(a) a cabinet frame having a front, a rear and a base;

(b) a storage container insert constructed of wood at least one inch thick removably installed within the cabinet frame, the storage container insert having at least two side panels, a top panel, a bottom panel and a rear panel joined by fasteners and defining a rectangular enclosure, the enclosure having an open front portion defined in frame-like manner by the side panels, top panel and bottom panel;

(c) wherein the storage container insert is sized relative to the cabinet frame such that when the storage container insert is installed with the open front portion proximate to the front of the cabinet frame, a space remains within the cabinet frame behind the rear panel;

(d) the storage container insert further comprising a raised sill across the bottom panel between the side panels, the sill being capable of containing at least a two inch depth of liquid within the enclosure;

(e) a bi-fold door biased to a closed position by a hydraulic door closer to seal the open front portion of the storage container insert, the bi-fold door being constructed of wood at least one inch thick; and (f) a door catch device for retaining the door in an open position and releasing the door in the presence of a preselected ambient temperature, the door catch device further comprising a magnetic catch with a fusible link.

* * * * *